United States Patent [19]

Awano

[11] Patent Number: 4,629,271

[45] Date of Patent: Dec. 16, 1986

[54] ELECTRICAL CONNECTOR FOR FLEXIBLE CIRCUIT BOARDS

[75] Inventor: Yoshiyuki Awano, Kawasaki, Japan

[73] Assignee: E. I. Du Pont de Nemours and Company, Wilmington, Del.

[21] Appl. No.: 830,499

[22] Filed: Feb. 20, 1986

Related U.S. Application Data

[63] Continuation of Ser. No. 628,699, Jul. 6, 1984, abandoned.

[30] Foreign Application Priority Data

Aug. 1, 1983 [JP] Japan ..... 58-118700[U]

[51] Int. Cl.[4] ..... H01R 9/07

[52] U.S. Cl. ..... 339/75 MP; 339/17 F; 339/176 MF

[58] Field of Search ..... 339/17 F, 75 MP, 176 MF

[56] References Cited

U.S. PATENT DOCUMENTS

| | | | |
|---|---|---|---|
| 3,336,564 | 8/1967 | McCaughey | 339/99 |
| 3,432,795 | 3/1969 | Jayne | 339/176 MP |
| 3,432,799 | 3/1969 | Richards et al. | 339/99 |
| 3,874,762 | 4/1975 | Shott et al. | 339/91 |
| 3,963,319 | 6/1976 | Schumacher et al. | 339/176 |
| 4,070,082 | 1/1978 | Werner | 339/98 |
| 4,188,086 | 2/1980 | Inouye et al. | 339/176 |
| 4,266,839 | 5/1981 | Aikens | 339/75 MP |
| 4,367,006 | 1/1983 | Rehbogen, Jr. et al. | 339/176 MF |
| 4,435,034 | 3/1984 | Aujla et al. | 339/98 |
| 4,480,886 | 11/1984 | Bergamin | 339/176 MF |

FOREIGN PATENT DOCUMENTS

| | | |
|---|---|---|
| 0014037 | 8/1980 | European Pat. Off. . |
| 124793 | 10/1978 | Japan . |

*Primary Examiner*—John McQuade

[57] ABSTRACT

Connector for flexible printed wiring circuit board having a housing with multiple parallel insertion chambers, a resilient member within each insertion chamber to hold leads from the circuit board and a pressure insertion component for maintaining the leads in a fixed position. The pressure insertion component has parallel projections on one side, each adapted to fit in an insertion chamber. The projections are of variable length to permit smooth insertion.

1 Claim, 3 Drawing Figures

FIG. 1
PRIOR ART
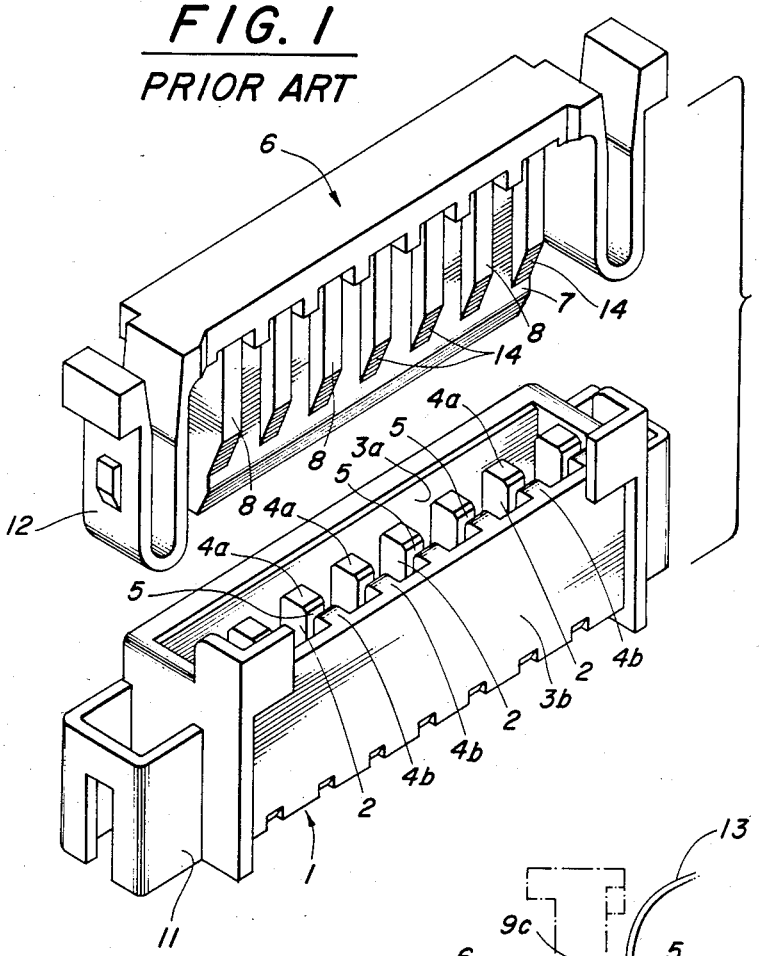
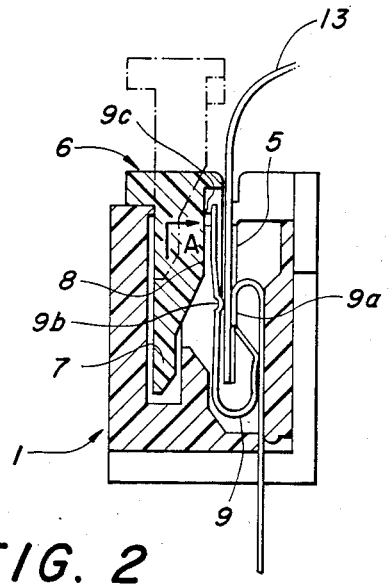
FIG. 2
PRIOR ART

ELECTRICAL CONNECTOR FOR FLEXIBLE CIRCUIT BOARDS

This application is a continuation of application Ser. No. 628,699, filed 7/6/84 now abandoned.

BACKGROUND OF THE INVENTION

1. Field of the Invention

This device relates to an improved electrical connector for the purpose of connecting lead wires such as those of printing wiring circuit boards in a simple way.

2. Description of the Prior Art

Many connectors for printing wiring circuit boards have been developed in recent years and there have been disclosed Japanese patents and utility model registration applications such as Patent Early Disclosure No. 55[1980]-69979, Utility Model Disclosure No. 55[1980]-108689, Patent Early Disclosure No. 56[1981]-91384, Patent Public Disclosure No. 56[1981]-1753 and Utility Model Disclosure No. 58[1983]-5380.

Representative examples of these devices will be described subsequently in detail by reference to the figures. They are long and narrow, box-shaped frame devices formed of an electrical insulating material and consisting of an assemblage of a part having numerous insertion chambers arranged in a row in the direction of the length at equal intervals from each other and a pressure insertion component made of the same electrical insulating material and which has a dovetailing projection arranged in a comb-shaped pattern that fit into each insertion chamber. A resilient connecting device that holds the connecting lead wires is installed in each insertion chamber of the frame shaped component. The pressure insertion components having dovetailing projections that correspond to the aforementioned insertion chambers. When they are inserted into the insertion chambers, they have a part that affixes the resilient connecting device, and as a result of bringing the two components together, multiple connecting lead wires can be easily connected at one time.

A type that has been in wide use most recently is one whereby the connecting lead wires are printed at equal intervals from each other in parallel patterns on flexible printed wiring circuit boards, with the circuit boards being inserted between the aforementioned frame-shaped component and pressure insertion component so that the lead wires become connected.

The dovetailing projections of the pressure insertion component may be formed independently or they may be formed as a ridge facing the backplate.

However, in the type of apparatus represented, for example, in Japanese Utility Model Disclosure No. 58[1983]-6380, the dovetailing projections of the pressure insertion component are all of equal length and their front edges are parallel to the top surface of the frame-shaped component. When a pressure insertion component of this shape is inserted into the frame-shaped component, a discrepancy occurs in the adjustment between the dovetailing projections and the insertion chambers. In addition, because the contact between the dovetailing projections and the frame-shaped component via the connecting lead wires begins simultaneously, an abrupt increase in the pressure load occurs so that operational difficulties arise.

SUMMARY OF THE INVENTION

This device is intended to eliminate the drawbacks of existing technologies. By means of this device, an electrical connector is provided for the purpose of connecting lead wires. The connector consists of a first part which is a long and narrow, frame-shaped component formed of an electrical insulating material and which has insertion chambers, set in a row in the direction of the length, at equal intervals from each other. A resilient component which is formed of a conductive spring material is inserted into and affixed in each insertion chamber. The resilient component holds the connecting lead wires. A pressure insertion component formed of an electrical insulating material and which has dovetailing projections that fit into the insertion chambers of the aforementioned frame-shaped component in positions corresponding to said insertion chambers also holds the connecting lead wires by affixing the resilient connecting component which holds the connecting lead wire. This connector is characterized by the fact that the front edges of the tips of the dovetailing projections of the aforementioned pressure insertion component do not form straight lines parallel to the front edges of the openings of the insertion chambers, as a result of which, sudden increase in pressure load does not occur when insertion is begun at the time the pressure insertion component is inserted into the frame-shaped component so that insertion can be accomplished smoothly.

Within the broad concept of this device, the front edges of the dovetailing projections need not form straight lines that are parallel to the front edges of the openings of the insertion chambers. That is, all of the dovetailing projections may be at least of two different lengths. However, ideal modes of execution include one in which the dovetailing projections at the two ends are the longest and one in which the dovetailing projections become successively shorter. In connectors for the purpose of connecting extremely large numbers of connecting lead wires, the row can consist of repeated cycles of dovetailing projections that become successively shorter from the longest to the shortest. In this case, the dovetailing projections at the two ends of the pressure insertion component should be the longest.

The lead wire connector of this type can be applied to cases in which the dovetailing projections have a backplate and to cases in which they do not. It can be applied to cases in which multiple connecting lead wires are wired by printing to circuit boards and to cases in which they are held by a suitable support device.

BRIEF EXPLANATION OF THE DRAWINGS

In the drawings,

FIG. 1 is a perspective view showing the shape of a typical connecting lead wire connector based on conventional technology and which was the forerunner of this device.

FIG. 2 is a cross-section showing the mode of connecting printed wiring connecting lead wires by the connector shown in FIG. 1.

DESCRIPTION OF THE PREFERRED EMBODIMENT

Figure 3:
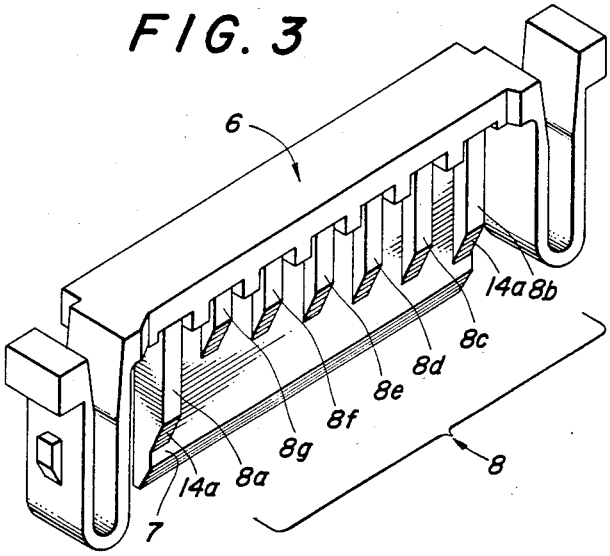
FIG. 3 is a perspective view showing the shape of the pressure insertion component of the connecting lead wire connector of this device.

FIG. 1 shows an existing connector of the type to which this device belongs. The connector consists of the frame-shaped component 1 and the pressure insertion component 6, both of which are made of insulating materials. Multiple insertion chambers 2, for the purpose of inserting the resilient connecting component (the component 9 shown in FIG. 2), are set at equal intervals from each other, being separated by the partitions 4*a* and 4*b* which are formed as ridges from the long walls 3*a* and 3*b*. The groove 5 for the purpose of receiving the printing wiring circuit board is provided along the direction of the length of the frame-shaped component 1 between the partitions 4*a* and 4*b*. The dovetailing projections 8, which fit into the insertion chambers 2 of the frame-shaped component 1, are set like the teeth of a comb in the pressure insertion component 6. In the mode shown in the figure, the dovetailing projections 8 are formed into a single entity with the backplate (hereafter called the working plate) 7 as a ridge. A gap is provided in the frame-shaped component 1 between the long wall 3*a* and the partition 4*a* for the purpose of inserting the working plate.

The flexible plastic insertion stop devices 12 are installed at both ends of the pressure insertion component 6 and the stop frame devices 11 that receive and stop the aforementioned plastic insertion stop devices 12 are installed on both ends of the frame-shaped component 1.

FIG. 2 is a cross-section showing a state in which termination of connecting lead wires has been achieved by placing the printing wiring circuit lead wire 13 between the aforementioned frame component and the pressure insertion component. The resilient connecting component 9, which was mentioned previously, is a fine metal band bent into an S shape. A first end is extended in a straight line so as to come into resilient contact with the convexly curved portion 9*a* of the S. The second end also has a shape that is extended parallel to said straight line. The second end pierces the bottom of each insertion chamber 2 of the frame-shaped component 1 and leads to the outside. The initial convexly curved portion 9*a*, which is continuous with this second end, is inserted and fixed so that it faces the inner side of the frame-shaped component 1.

When the printed wiring lead wire 13 is connected with this type of connector, the lead wires are printed in parallel and at equal intervals on the printed circuit board. It goes without saying that the insertion chambers 2 of the frame-shaped component 1 are set at intervals congruent with those of the printed wiring lead wires.

In order to connect the printed wiring lead wire 13 with a connector such as described above, the printed wiring board (which should be flexible) 13 is inserted so that the wiring comes into contact with the convexly curved portion 9*a* of the resilient connecting component 9. Following that, the pressure insertion component 6 is inserted so that the dovetailing projections 8 with lead in edges 14 fit into the insertion chambers. Since the thicknesses of the dovetailing projections are set so as to be essentially equal to the thicknesses of the partitions 4*a* of the frame-shaped component 1, the dovetailing projections compresses the extended portion of the first end of the resilient connecting component into which the printed wiring circuit board is inserted from the back. In order to complete the contact between the lead wire and the elastic connecting component, the small projection 9*b*, which faces the convexly curved portion, is set in the resilient connecting component 9 at the point at which the extended portion of the first end comes into contact with the convexly curved portion that is continuous with the second end. Further, the small projection 9*c* is set on the opposite side near the tip, i.e., facing the dovetailing projection. Consequently, contact between the fixing of the lead wire and the resilient connecting component are completely achieved by inserting the pressure insertion component into the frame-shaped component.

However, as was indicated previously, when connection is performed using this apparatus, contact between all of the dovetailing projections and (the small projections 9*c* of) the elastic connecting components begins at the same time, the force required for insertion increases abruptly, with difficulty in operation occurring. When the working plate (backplate 7) is not present, a discrepancy occurs in the adjustment between the dovetailing projections and the insertion chambers at the time of insertion. This device is one in which the aforementioned drawback of the conventional technology is eliminated.

The distinctive characteristic of this device is the shape of the pressure insertion projections. In other respects, it is essentially the same as the conventional technology described in the foregoing text. FIG. 3 is a perspective view showing the shape of the pressure insertion component of an apparatus that is a suitable mode of execution of this device. This pressure insertion component is essentially identical in shape to that explained by reference to FIG. 2. However, the two end projections 8*a* and 8*b* of the dovetailing projections 8 are made as the longest, with the projections becoming shorter from projection 8*c*, which is next to 8*b*.

The frame-shaped component corresponding to it is identical to that shown in FIG. 1. By providing a structure of this kind, the long dovetailing projections 8*a* and 8*b* with the lead in edges 14*a* at the two ends function as guides when the pressure insertion component is inserted into the frame-shaped component. Insertion begins in sequence from 8*c*, with overall insertion proceeding extremely smoothly. Thus, occurrence of twisting due to high insertion pressure forces and damage to the components as a result of twisting are prevented.

The foregoing concrete example is a suitable mode of execution. However, this device is not limited to this mode, being limited only as described in the claims.

I claim:

1. An electrical connector for the purpose of terminating lead wires on flexible circuit boards consisting of a long and narrow, frame-shaped component formed of an electrical insulating material having insertion chambers set in a row in the direction of the length at equal intervals from each other, a resilient connecting component which is formed of a conductive resilient material that is inserted into and affixed in each insertion chamber and which holds the lead wires, a longitudinally extending pressure insertion component formed of an electrical insulating material having on one side surface a series of parallel dovetailing projections set like teeth of a comb in said pressure insertion component, said projections having lead in edges that fit into the insertion chambers of the frame-shaped component in positions corresponding to the insertion chambers and that hold the lead wires by affixing the resilient connecting component which holds the lead wire, the first and the last dovetailing projections of the series being substantially the same length which is longer than any of the other dovetailing projections of said series, said other dovetailing projections progressively descreasing in length so that the next longest projection is adjacent to said first projection and the shortest is adjacent the last projection, said first and last projections functioning as guides when the pressure insertion component is inserted into the frame-shaped component, and said other projections providing smooth insertion due to the sequential insertion of each of said other projections into its respective insertion chamber.

* * * * *